United States Patent [19]

Watanabe

[11] Patent Number: 4,810,927

[45] Date of Patent: Mar. 7, 1989

[54] COLOR DISPLAY TUBE WITH SHADOW MASK AND FABRICATING METHOD THEREOF

[75] Inventor: Tetsuya Watanabe, Nagaokakyo, Japan

[73] Assignee: Mitsubishi Denki Kabushiki Kaisha, Tokyo, Japan

[21] Appl. No.: 861,253

[22] Filed: May 9, 1986

[30] Foreign Application Priority Data

May 29, 1985 [JP] Japan ..... 60-118167

[51] Int. Cl.[4] ..... H01J 9/02; H01J 29/07

[52] U.S. Cl. ..... 313/402; 445/47

[58] Field of Search ..... 313/402; 445/47; 148/6.35; 427/78, 123

[56] References Cited

U.S. PATENT DOCUMENTS 3,887,828 6/1975 Bathelt et al. ..... 313/402

*Primary Examiner*—David K. Moore
*Assistant Examiner*—K. Wieder
*Attorney, Agent, or Firm*—Lowe, Price, LeBlanc, Becker & Shur

[57] ABSTRACT

A shadow mask (13) in accordance with the present invention comprises: an iron plate (14) having many apertures (15) for electron beams, wherein each of the apertures comprises a relatively medium diameter portion (15*c*), a relatively smaller diameter portion (15*b*), a relatively larger diameter portion (15*a*) in order from one side of the plate in which said one side is to be irradiated by the electron beam; a first surface-treated layer of $Fe_3O_4$ which covers the allover surface of the plate; and a second layer (5) for preventing thermal strain of the plate caused by heat due to energy of the electron beams, wherein said second layer is applied over said first layer only on said one side of the plate.

8 Claims, 2 Drawing Sheets

COLOR DISPLAY TUBE WITH SHADOW MASK AND FABRICATING METHOD THEREOF

BACKGROUND OF THE INVENTION

1. Field of the Invention

This invention relates to a shadow mask for a color cathode-ray tube (C-CRT) and more particularly to prevention of thermal strain of the shadow mask.

2. Description of the Prior Art

Referring to FIG. 1, there is schematically shown an exploded perspective view of a C-CRT. A glass enclosure of a C-CRT comprises a panel portion 10 and a funnel portion 12. An electron gun 11 is provided inside a neck portion of the funnel 12. The panel 10 is to be welded to the funnel 12 with glass frit, enclosing a shadow mask 13 which is fixed to the panel 10 by support members.

A method for fabricating a shadow mask is described in *Electronic Science,* 1964, Vol. 14, No. 9, pp. 36 and 39–40 published by Sanpou Inc. of Japan.

Referring to FIG. 2, there is shown an enlarged fragmentary sectional view of a basic plate in a conventional shadow mask. A shadow mask 13 comprises a basic iron plate 14 of 0.15–0.25 mm thickness which has a plurality of apertures 15 for electron beams. Each of those apertures is generally circular or rectangular in shape.

At first, the basic iron plate is flat in shape and is subjected to a heat treatment (at 700°–920° C. in an atmosphere of hydrogen). The iron plate is then pressed to conform it to the spherical shape of the inner surface of the panel 10. Thereafter, the pressed plate is subjected to a surface treatment for coating the plate with black rust. This surface treatment is called "blackening process". In the blackening process, the iron plate is immersed into an alkaline solution containing an oxidizing agent. Alternatively, the black rust coating can also be obtained using steam or carbon oxide gas. The black rust coating thus obtained prevents red rust on the basic plate when the shadow mask is heated to about 400° C. in the air during the assembling process of the C-CRT.

In the meantime, about 80% of electrons emitted from the gun 11 impinge upon the shadow mask 13 and kinetic energy of those electrons is converted into heat energy. Due to the heat thus generated, the shadow mask expands thermally and causes a thermal strain. The above described black rust coating increases the thermal emissivity of the shadow mask to about 0.75 and thus reduces the thermal strain of the shadow mask. In view of reproduction of images with high fidelity in recent C-CRTs, it is desirable that the panel face is made flat, that the density of picture elements is increased and that the images are brightened and made more clear. To satisfy these demand, it is required that the size of apertures for electron beams and the pitch of those apertures both need to be small. The smallest size of the apertures depends on the thickness of the basic plate for a reason of processing technique. To form apertures 0.150 mm in diameter, it is necessary that the basic plate is as thin as 0.150 mm in thickness.

The conversion ratio of kinetic energy of electron beams into thermal energy depends on the thickness of the shadow mask. When the basic plate is thin, the above described black rust ($Fe_3O_4$) coating with the emissivity of about 0.75 is not enough to prevent the thermal strain of the shadow mask 13.

SUMMARY OF THE INVENTION

In view of the prior art, it is a major object of the present invention to prevent the thermal strain of the shadow mask.

A shadow mask in accordance with the present invention comprises: a basic metal plate having a plurality of apertures for electron beams, wherein each of the apertures comprises a relatively medium diameter portion, a relatively smaller diameter portion and a relatively larger diameter portion in order from one side of the plate in which said one side is to be irradiated by the electron beams; a first surface-treated layer of black rust which covers the allover surface of the plate; and a second layer for preventing thermal strain of the plate caused by heat due to energy of the electron beams, wherein said second layer is applied over said first layer only on said one side of the plate.

A method for fabricating a shadow mask in accordance with the present invention comprises steps of: preparing a basic metal plate having a plurality of apertures for electron beams, wherein each of the apertures comprises a relatively medium diameter portion, a relatively smaller diameter portion and a relatively larger diameter portion in order from one side of the plate in which said one side is to be irradiated by the electron beams; coating the allover surface of the plate with a surface-treated layer; setting at least a couple of the plates into a state in which the other side of each of the plates faces the same other side of the remaining plate(s); and spraying said one side of the plate with powder by a electrostatic spray method.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
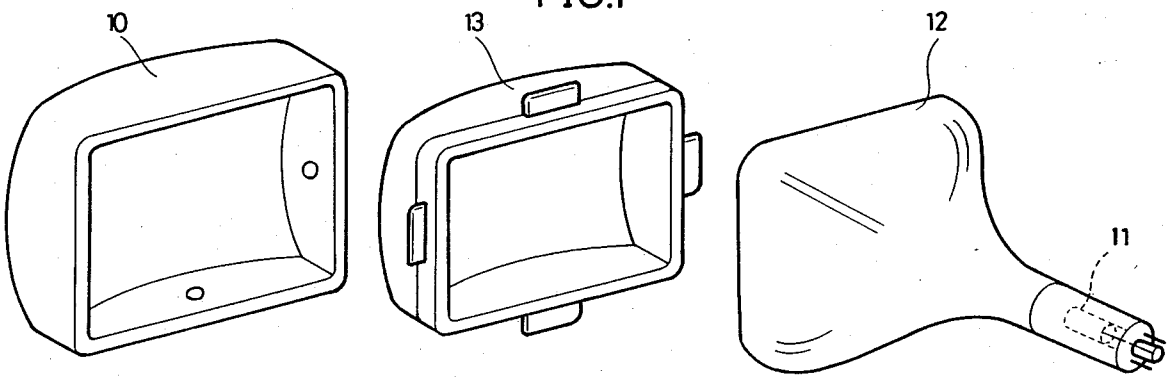
FIG. 1 is an exploded perspective view of a C-CRT.
Figure 2:
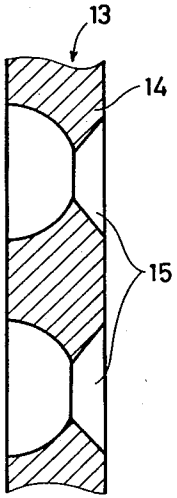
FIG.2 PRIOR ART
FIG. 2 is a fragmentary sectional view of a basic plate in a conventional shadow mask.
Figure 3:
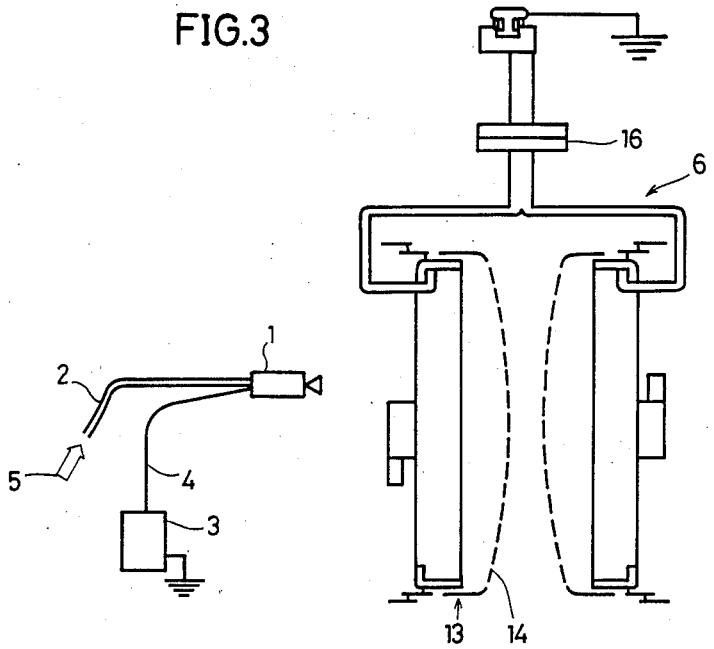
FIG. 3 illustrates an electrostatic powder-spray apparatus used in the present invention.

Referring to FIG. 3, there is schematically illustrated an electrostatic powder-spray apparatus used in a method for fabricating a shadow mask in accordance with the present invention. A spray gun 1 is fed with powder 5 through a tube 2 and is connected to a high voltage source 3 through a cable 4. A hanger 6 hangs at least a couple of shadow masks 13 and is grounded electrically. Each of the hung shadow masks comprises a basic plate 14, the allover surface of which is already coated with a black rust ($Fe_3O_4$) layer (not shown) formed by a well-known method. Any one of the hung shadow masks 13 can be selected and placed in the face of the spray gun 1 through a rotatable joint 16. The gun 1 sprays powder 5 over one side of the basic plate 14 in which said one side is to be irradiated by electron beams in a completed C-CRT. For example, powder of lead borate glass (ASF-1307B: 74.9 wt % PbO, 8.6 wt % $B_2O_3$, 12.6 wt % ZnO, 2.0 wt % $SiO_2$, 1.9 wt % BaO, 1.0 wt % Co-Fe-Mn spinel) is sent to the gun 1 by pressurized air and then is charged with about 100 KV led from the high voltage source 3.

Figure 4:
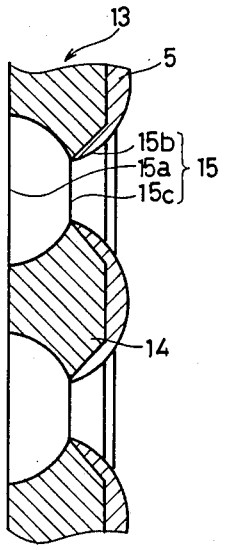
FIG. 4 is a fragmentary sectional view of a shadow mask in accordance with the present invention.

Referring to FIG. 4, there is shown an enlarged fragmentary sectional view of a sprayed basic plate. A basic plate 14 has apertures 15 for electron beams. Each of the apertures 15 comprises a relatively medium diameter portion **15*b*, a relatively smaller diameter portion 15*c*, and a relatively larger diameter portion 15*a* in order from one side of the plate 14 in which said one side is to be irradiated by the electron beams. Powder 5 sprayed by the gun 1 is deposited electrostatically over said one side of the plate 14 in which said one side includes an area from the medium diameter portion 15*b* to the smaller diameter portion 15*c* in each of the apertures 15. The deposited powder layer 5 is then sintered at 440° C. for about 30 min. The sintered powder layer 5 surely prevents thermal strain of the shadow mask 13** caused by heat due to energy of the electron beams.

In a conventional spray method, it is probable that the powder sprayed toward one side of the plate 4 scatters out from the other side through the apertures 15. Such scattering of the powder is prevented in the above described spray method in accordance with the present invention, since the shadow mask to be sprayed is set to face the other shadow mask which has the same electrical potential. Concomitantly, only the area from the medium diameter portion **15*b* to the smaller diameter portion 15*c* in each of the apertures 15** is coated by the powder, as described above and shown in FIG. 4.

Although the powder of lead borate glass has been described in the above described embodiment, it is also possible to use powder which contains a heavy metal element as a major element and has a specific gravity larger than 4.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method for fabricating a shadow mask (13), comprising steps of preparing a basic metal plate (14) having a plurality of apertures (15) for electron beams, wherein substantially each of the apertures comprises a medium diameter portion (**15*b*), and relative thereto a smaller diameter portion (15*c*) and a larger diameter portion (15*a*) respectively arranged in order from one side of the plate in which said one side is to be irradiated by the electron beams, coating an allover surface of said one side of the plate with a surface-treated layer, positioning at least a couple of the plates into a state in which the other side of each of those plates faces the same other side of the remaining plates, and electrostatically spraying said one side of the plate with powder (5**).

2. The method in accordance with claim 1, wherein said powder contains lead borate glass as a principal component.

3. The method in accordance with claim 1, wherein said powder contains a heavy metal element as a major element.

4. The method of claim 1, wherein said other sides facing each other during electrostatic spraying have substantially the same electric potential.

5. The method of claim 1, wherein said powder is applied over said one side of said plate to form convex portions of powder material between said apertures.

6. The method of claim 5, wherein said convex portions of said powder are in substantially spherical shape.

7. The method of claim 1, further comprising thermal treatment of the plate which takes place at approximately 440° C. for about thirty minutes.

8. A method of fabricating a shadow mask comprising the steps of preparing a basic metal plate having a plurality of apertures for electron beams, wherein each of the apertures comprises a relatively medium diameter portion, a relatively smaller diameter portion and a relatively larger diameter portion in order from one side of the plate in which said one side is to be irradiated by the electron beams, coating the allover surface of the plate with a surface-treated layer, setting at least a couple of the plates into a state in which the other side of each of those plates faces the same other side of the remaining plate(s), and placing an electrostatic powder-spray apparatus at a distance away from said one side of one of the plates, and spraying a second layer over said one side of the plate which is facing the electrostatic powder-spray apparatus with powder from the electrostatic powder-spray apparatus.

* * * * *